US008002141B2

(12) United States Patent
Duffield

(10) Patent No.: US 8,002,141 B2
(45) Date of Patent: Aug. 23, 2011

(54) WATERPROOF STORAGE UNIT

(75) Inventor: Marshall Duffield, Newport Beach, CA (US)

(73) Assignee: Duffield Marine, Inc., Costa Mesa, CA (US)

( * ) Notice: Subject to any disclaimer, the term of this patent is extended or adjusted under 35 U.S.C. 154(b) by 333 days.

(21) Appl. No.: 12/194,266

(22) Filed: Aug. 19, 2008

(65) Prior Publication Data

US 2008/0302809 A1 Dec. 11, 2008

Related U.S. Application Data

(63) Continuation of application No. 11/145,842, filed on Jun. 6, 2005, now abandoned.

(51) Int. Cl.
*B65D 6/28* (2006.01)
*B65D 8/04* (2006.01)
*B65D 8/18* (2006.01)

(52) U.S. Cl. ..... 220/677; 220/614; 220/617; 220/890; 52/79.1

(58) Field of Classification Search ..... 220/1.5, 220/614, 617, 677, 890; 52/79.1
See application file for complete search history.

(56) References Cited

U.S. PATENT DOCUMENTS 2,055,339 A * 9/1936 Dalton ..... 220/4.01
2,162,137 A * 6/1939 Torricelli ..... 52/142
2,901,122 A 8/1959 Edman
4,221,536 A * 9/1980 McFee ..... 414/812
4,476,657 A 10/1984 Juba et al.
4,909,268 A 3/1990 Maggio
5,417,344 A * 5/1995 Wells et al. ..... 220/571
5,724,774 A 3/1998 Rooney
5,921,043 A * 7/1999 McDonald ..... 52/309.9
6,053,591 A 4/2000 Kasanic
6,427,256 B1 8/2002 Mullett et al.
2003/0140573 A1 7/2003 Marcinkowski et al.
2003/0150769 A1 * 8/2003 Lau ..... 206/600

OTHER PUBLICATIONS

Lear Baylor, Inc. "Lear Letric Propulsion System"; Website Article; http://www.learbaylor.com; 2 pages.

* cited by examiner

*Primary Examiner* — Anthony Stashick
*Assistant Examiner* — Madison L Wright
(74) *Attorney, Agent, or Firm* — Stetina Brunda Garred & Brucker

(57) ABSTRACT

A storage unit which is substantially water proof is provided. The storage unit may comprise a shell having lower edges which mate into a groove formed in a top surface of a base to provide a substantially waterproof barrier therebetween. The junction between the lower edge of the side walls and the first groove may be sealed with a water proof sealant. A front side wall of the shell may have an aperture therethrough to allow users to move items into and out of the storage unit. A door may be attached to the storage unit to prevent water from entering into the storage unit through the aperture. Moreover, a lower edge of the door body may be inserted into a second groove formed in the top surface of the base to prevent water from entering into the storage unit from under the door.

3 Claims, 4 Drawing Sheets

WATERPROOF STORAGE UNIT

CROSS-REFERENCE TO RELATED APPLICATIONS

The present application is a continuation application of prior U.S. application Ser. No. 11/145,842, filed Jun. 7, 2005, the disclosure of which is incorporated herein by reference.

STATEMENT RE: FEDERALLY SPONSORED RESEARCH/DEVELOPMENT

Not Applicable

BACKGROUND

The present invention relates to storage units which are substantially waterproof.

Outdoor sheds may be used to store items such as tools and equipment. Outdoor sheds are typically constructed from four walls, a roof and a floor which are connected to each other to provide an interior storage area protected from the environment (e.g., rain, etc.). In particular, the four walls may be connected end to end in a square or rectangular configuration. The roof may be laid over the walls to prevent rain from entering the interior storage area. More particularly, the roof may overhang the walls such that rain rolls off of the roof onto the ground. One of the walls may have a door to allow items to be placed within and removed from the shed. The floor may be attached to the bottom edges of the four walls such that the shed may be placed on dirt, gravel or other solid foundation.

Unfortunately, the shed construction discussed above does not substantially prevent water from entering the interior storage area of the shed. As such, items stored within the shed may become wet. For example, water may seep into the interior storage area through the junction between the roof and the four walls because, as stated above, they are fabricated from separate panels. Water may also seep into the interior storage through the joint between the four walls themselves. Additionally, the floor may be fabricated from a thin sheet metal such that water may seep into the interior storage area when the surrounding area is flooded.

Accordingly, there is a need in the art for a shed which is substantially waterproof.

BRIEF SUMMARY

The various aspects of the present invention discussed herein resolve the deficiencies of the prior art discussed above as well as other deficiencies. In an aspect of the present invention, a storage unit is provided. The storage unit may comprise a top and a plurality of side walls (e.g., front, rear, left and right) which are fabricated from a unitary material. This urges rain that falls on the top to smoothly roll off of the top onto the side walls. Further, since the top and the side walls are fabricated from a unitary material, the rain water may not seep into an interior storage area of the storage unit at the junction thereof.

In another aspect of the present invention, the top may further have a curved configuration which urges rain that falls on the top away from an entrance of the storage unit. In particular, the top may be bowed upwardly from the left and right sides of the storage unit. In this manner, rain that falls on the top is urged toward the left and right sides of the storage unit and only minimal amounts of water roll off of the top water onto the front side wall of the storage unit thereby minimizing the opportunity for water to enter the storage unit through the entrance.

In another aspect of the present invention, the side walls and the top define a shell. The bottom edges of the side walls/shell may be inserted into a groove formed in a base. The bottom edges and groove may be sized and configured to the bottom edges such that the bottom edges fit snugly into the groove. In this manner, water that rolls down the sides of the storage unit does not seep into the storage unit at the junction of the shell and the base. Further, the junction of the shell and base may also be caulked with a waterproof sealant.

In another aspect of the present invention, the base of the storage unit may be sufficiently thick such that the interior storage area of the storage unit remains dry even though the surrounding area is flooded. In particular, the level of the storage area may be above the level of the flood water surrounding the storage unit. In this manner, the flood waters remains below the level of the storage area such that items stored on the storage area remains dry.

In another aspect of the present invention, the storage unit may have a roll up door. A bottom edge of a door body of the roll up door may be inserted into a door groove formed in a top surface of the base. The door groove is sized and configured to receive the door body's bottom edge when the door body is traversed to a closed position. Also, the door body's bottom edge may be removed from the door groove when the door body is traversed to an opened position. This construction prevents water from seeping into the storage area under the door.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
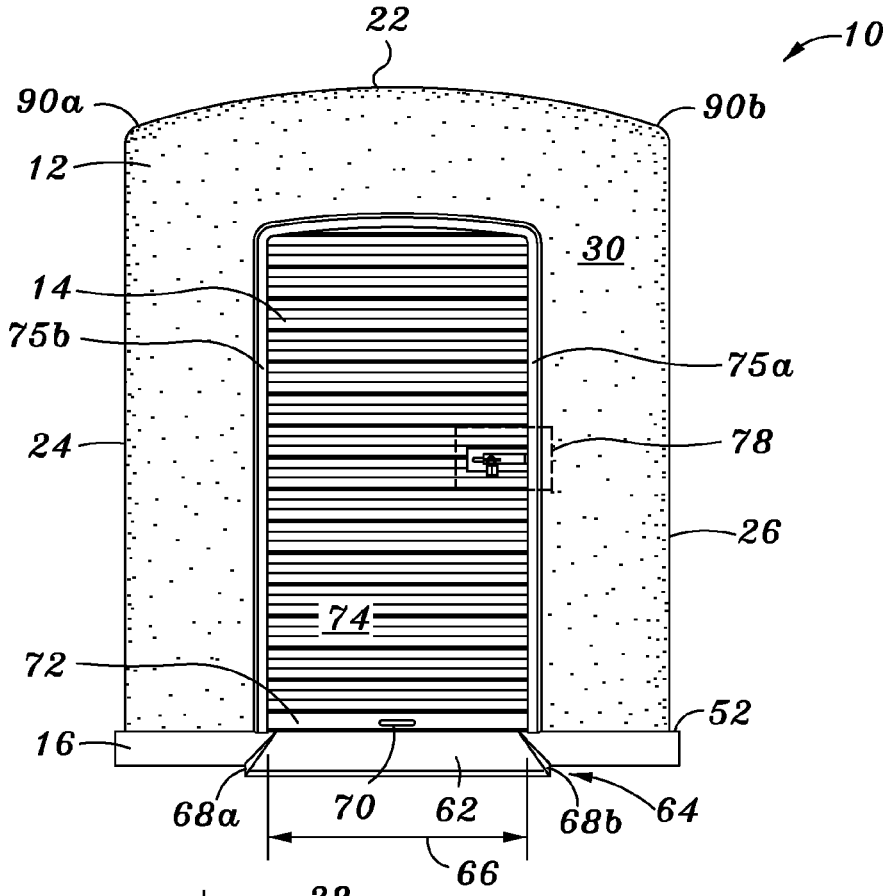
FIG. 1 is a front view of a storage unit with a door in a closed position.

The drawings which are referred herein are for the purpose of clarifying various aspects of the present invention and not for the purpose of limiting the scope thereof. Referring now to FIG. 1, a storage unit 10 which is substantially water proof so as to keep items stored therein dry from rain and water splashes is shown. The storage unit 10 has a number of unique constructions such that water is prevented from entering an interior storage area of the storage unit 10.

Figure 2:
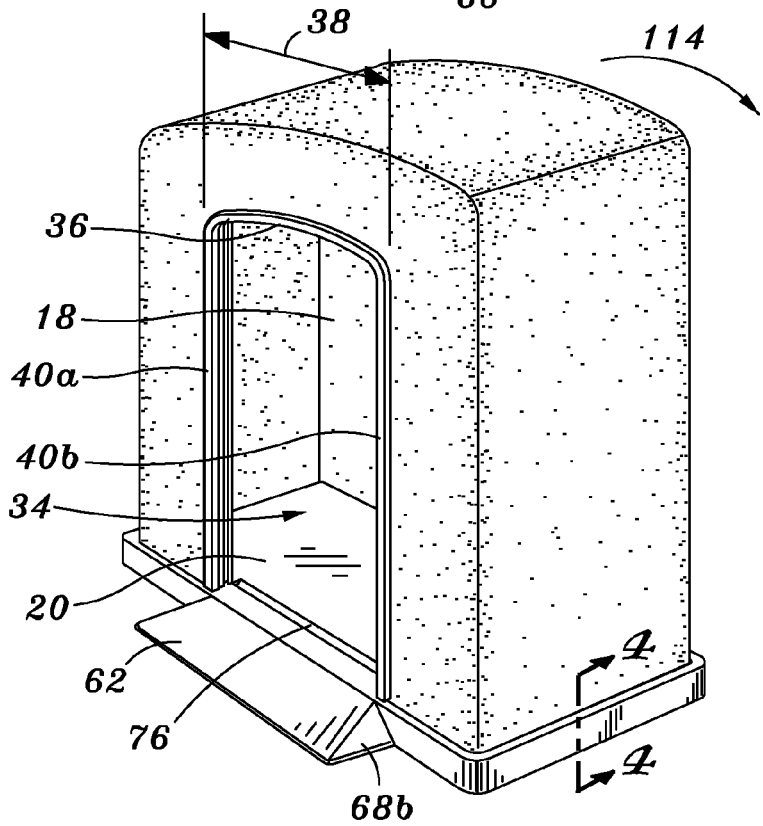
FIG. 2 is a perspective view of the storage unit of FIG. 1 with the door in an opened position.

The storage unit 10 may comprise a shell 12, door 14 and a base 16 which define an interior cavity 18 (see FIG. 2) of the storage unit 10. These parts (i.e., the shell 12, door 14 and base 16) encapsulate or otherwise prevent water from entering the interior cavity 18 due to rain or water splashes. For example, the door 14 may be traversed between a closed position (see FIG. 1) and an opened position (see FIG. 2). The opened position (see FIG. 2) allows users to place items into the interior cavity 18 or to remove items from the interior cavity 18. However, water may enter the interior cavity 18 when the door is in the opened position. To prevent water from entering the interior cavity 18, the door 14 may be traversed to the closed position (see FIG. 1) to block water from entering the interior cavity. Accordingly, the storage unit 10 provides an interior cavity 18 and a storage area 20 which is substantially water proof to rain and water splashes.

Figure 3:
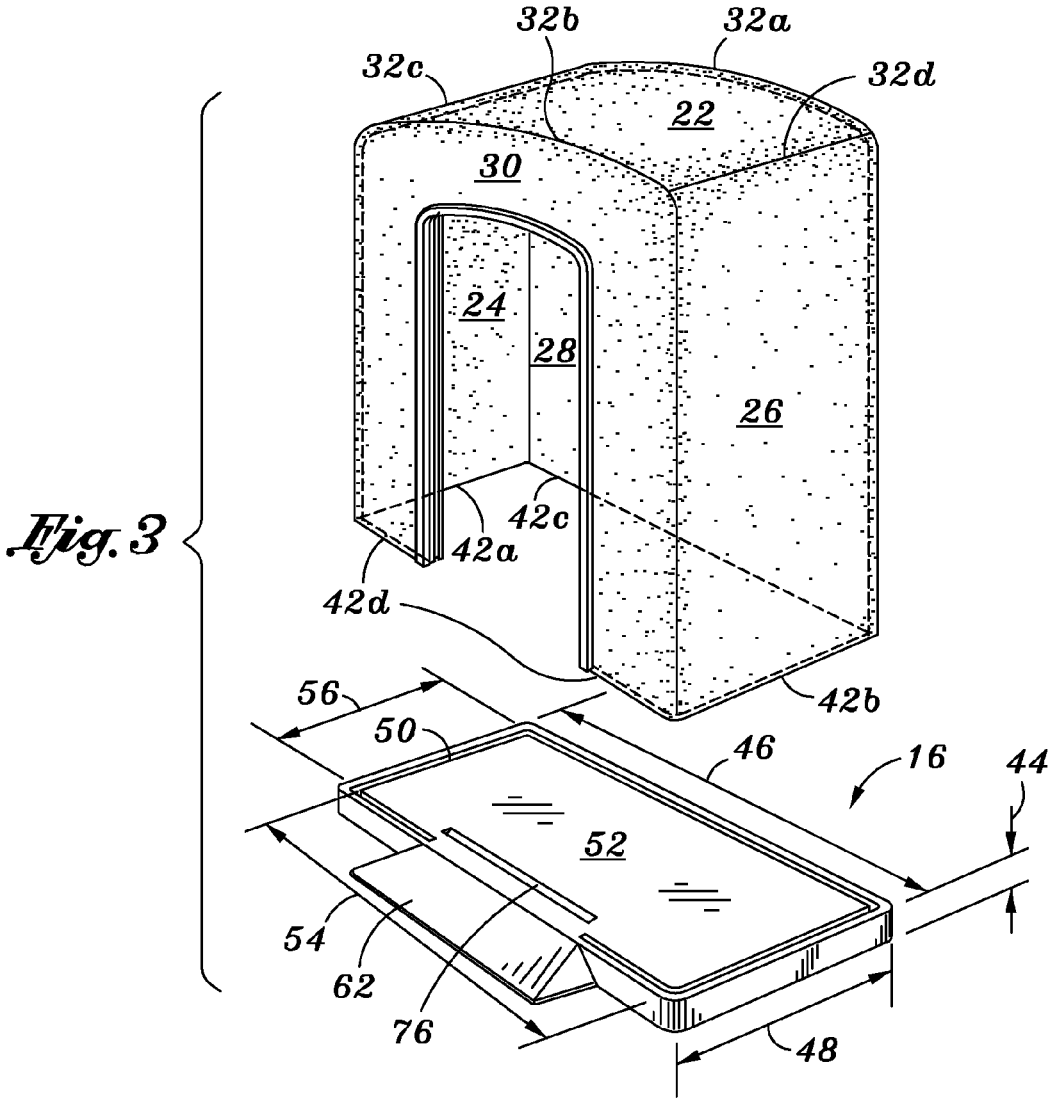
FIG. 3 is an exploded perspective view of the storage unit of FIG. 1 illustrating that the bottom edges of the shell is insertable into a groove formed about a perimeter of the top surface.

As shown in FIG. 3, the shell may have a top 22, left side wall 24, right side wall 26, rear wall 28, and a front wall 30. The top 22 may be attached to the walls 24, 26, 28, 30 such that rain that falls onto the top 22 rolls off onto the walls 24, 26, 28, 30. More particularly, the top 22 and the walls 24, 26, 28, 30 may be fabricated from a unitary material such that water does not leak through the shell 12 at the junction 32*a, b, c, d* of the top 22 and the walls 24, 26, 28, 30. Moreover, the unique curved shape (i.e., an inverted U shape) of the top 22 (see FIG. 1) urges water falling onto the top 22 away from the entrance 34 of the storage unit 10 to maintain the interior cavity 18 and storage area 20 (see FIG. 2) in a dry condition. In particular, top 22 may be bowed upwardly between the left side wall 24 and the right side wall 26, as shown in FIG. 1. When rain falls on the top 22, the rain water is urged toward the left and right side walls 24, 26 of the storage unit 10. As stated above, the top 22 and the left and right side walls 24, 26 may be fabricated from a unitary material which prevents water from leaking through the junction 32*a, b, c, d* into the interior cavity 18 of the storage unit 10. Water may still roll down the front side wall 30 but at a rate less than the amount of water rolling down the left and right side walls 24, 26.

Water that rolls off of the top 22 toward the front wall 30 may enter the interior cavity 18 via the entrance 34. However, the door 14 may be placed in the closed position (see FIG. 1) to urge such water away from the storage area 20. When the door 14 is in the opened position (see FIG. 2), water that rolls down the front wall 30 may be urged away from the storage area 20 via a lip 36 formed on an upper periphery 38 (see FIG. 2) of the entrance 34. The lip 36 may be a rubber shield which is attached to the upper periphery 38 of the entrance 34 such that water rolls off the lip 36 and away from the storage area 20. The lip 36 may also be formed about the side peripheries 40*a, b* of the entrance 34 to prevent water from entering the interior cavity 18.

Figure 4:
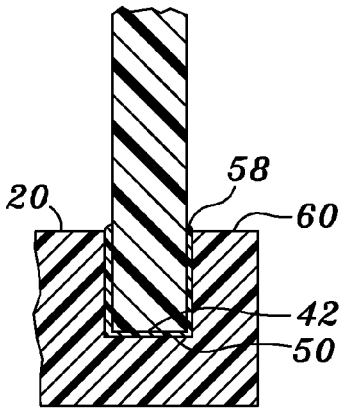
FIG. 4 is a cross sectional view of FIG. 2 illustrating the bottom edge of the side wall inserted into the corresponding groove formed in the top surface of the base wherein the entire surface of the groove is coated with a sealant.
Figure 4A:
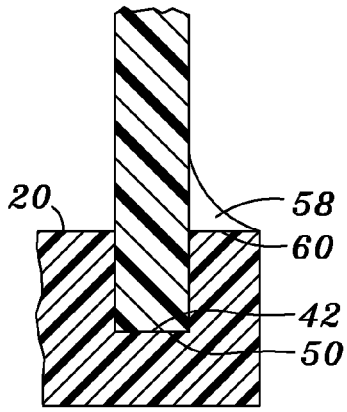
FIG. 4*a* is a cross sectional view of the side wall and the base wherein a water proof sealant is caulked on an exterior of the junction of the shell and base.
Figure 4B:
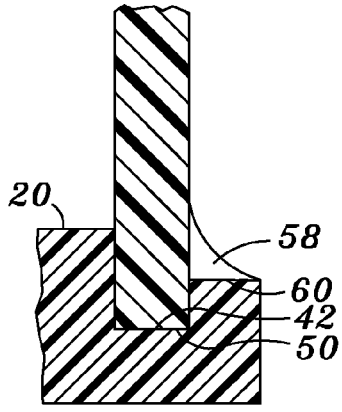
FIG. 4*b* is a cross sectional view of the side wall and the base wherein a level of the interior storage area is higher than a level of the outer perimeter of the base.

The bottom edges 42*a, b, c, d* of the four side walls 24, 26, 28, 30 may have a C-shaped configuration, as shown in FIG. 3. Further, as shown in FIGS. 4, 4*a*, 4*b* each of the bottom edges 42*a, b, c, d* may have a rectangular configuration. As shown in FIG. 3, the base 16 may have a rectangular configuration defining a thickness 44, length 46 and width 48. The base thickness 44 lifts the storage area 20 (see FIG. 2) above ground level such that the storage area 20 remains dry even if the surrounding area outside the storage unit 10 is flooded.

The length 46 and width 48 of the base 16 may be sufficiently large to receive the shell 12 thereon. A groove 50 (see FIG. 3) may be formed on a top surface 52 of the base 16. The top surface 52 is defined by the length 46 and width 48 of the base 16, whereas, the storage area 20 is defined by the length 54 and width 56 of the groove 50. The groove 50 may match the bottom edges 42*a, b, c, d* of the walls 24, 26, 28, 30. By way of example, the groove 50 may have a channel configuration for receiving bottom edges 42*a, b, c, d* with a corresponding square end configuration, as shown in FIGS. 4, 4*a*, 4*b*. Alternatively, it is within the scope of the present invention that the edges 42*a, b, c, d* may have other configurations and the groove 50 may have a configuration which corresponds to the edges 42*a, b, c, d* so as to allow the edges 42*a, b, c, d* to mate with the groove 50. A water proof barrier may be formed between the edges 42*a, b, c, d* and the groove 50 when the edges 42*a, b, c, d* engage/mate with the groove 50. Further, a sealant 58 may be disposed between the groove 50 and the edges 42*a, b, c, d*, as shown in FIGS. 4, 4*a*, 4*b* to further form a water proof barrier between the edges 42*a, b, c, d* and groove 50. By way of example, the sealant 58 may be applied to the entire surface of the groove 50, as shown in FIG. 4. Alternatively, the sealant 58 may be applied to the exterior perimeter of the groove 50, as shown in FIGS. 4*a* and 4*b*.

In another aspect of the storage unit, a perimeter portion 60 of the top surface 52 may be at the same height compared to the storage area 20, as shown in FIGS. 4 and 4*a*. Alternatively, the perimeter portion 60 of the top surface 52 may be at a lower level compared to the storage area, as shown in FIGS. 4*b*.

A main ramp 62 (see FIGS. 1-3) may be formed at the front of the base 16 which is also aligned to the entrance 34 of the storage unit 10. By way of example, the main ramp 62 may be narrower than the entrance 34, as shown in FIG. 1. The main ramp 62 may be useful to assist users in rolling items into and out of the storage unit 10. To this end, the ramp 62 may have a smooth inclined surface that starts from ground level 64 (see FIG. 1) and terminates at the level of the top surface 52. The width 66 of the ramp 62 may be sized to allow a standard dolly to be rolled into the storage unit 10 and may be narrower than the entrance 34, as stated above. The main ramp 62 may also have side ramps 68*a, b* (see FIGS. 1 and 2) which are inclined surfaces to prevent dollies that slip off of the main ramp 62 from falling abruptly onto the ground thereby unbalancing the load on the dolly.

Figure 5:
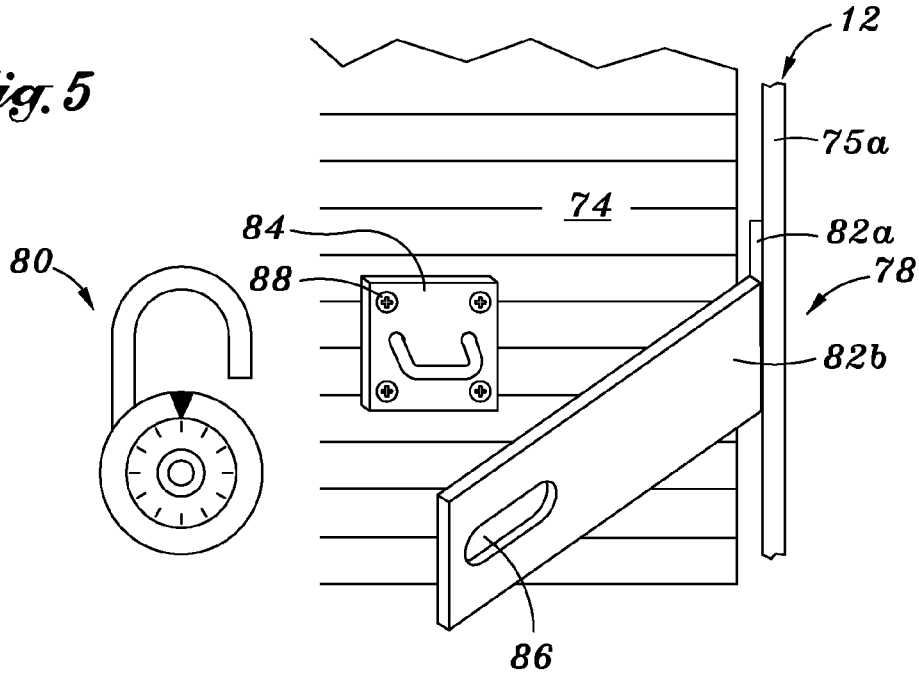
FIG. 5 is a close up view of a locking mechanism of FIG. 1 to lock the door in a closed position.

The door 14 may be a roll-up door which may be traversed between the opened position (see FIG. 2) and the closed position (see FIG. 1). The roll up door 14 may be rolled up or down via a handle 70 which is formed on a bottom edge 72 of the door body 74, as shown in FIGS. 1 and 5. The door body 74 may define left and right door edges 75*a, b*. Such edges 75*a, b* may be slid through side rails attached to the shell 12 at the entrance 34 to roll the door body 74 up or down. The side rails and the side edges 75*a, b* may have a substantially waterproof interface to prevent water from entering the storage unit 10 between the door body 74 and the front side wall 30.

The bottom edge 72 of the door body 74 may also mate with a door groove 76 (see FIGS. 2 and 3) formed in the top surface 52 of the base 16 when the door 14 is traversed to the closed position (see FIG. 1). The bottom edge 72 of the door body 74 may be removeably insertable into the groove 76. The groove 76 may be lined with a rubber material and the bottom edge 72 of the door body 74 may snugly fit into the door groove 76 thereby further promoting a substantially water proof barrier.

The door 14 may have a locking mechanism 78 (see FIGS. 1 and 5) to secure the door 14 in the closed position such that items within the storage unit 10 may not be removed without permission from the owner of the storage unit 10. The locking mechanism 78 may be a hasp, as shown in FIG. 5, with a padlock 80 to lock the door 14 in the closed position. In particular, the hasp may comprise a pair of hinged leaves 82*a, b* and a padlock eye 84. A first leaf 82*a* may be attached to the shell 12, and the padlock eye 84 may be attached to an exterior surface of the door body 74. The second leaf 82*b* may have an aperture 86 for receiving the padlock eye 84. To lock the door 14 in the closed position, the second leaf 82*b* is swiveled over the padlock eye 84 and the padlock eye 84 is received through the aperture 86. At this point, screws 88 and the like which were used to attach the padlock eye 84 and the first leaf 82*a* to the door body 74 and the shell 12, respectively, are covered to prevent unauthorized personnel from removing the locking mechanism 78 and breaking into the storage unit 10. The padlock 80 may be secured to the padlock eye 84 to immobilize the door body 74 thereby locking the door 14 in the closed position.

The unique construction of the storage unit 10 keeps the storage area 20 substantially dry even though it may be raining or the exterior surface of the storage unit 10 is being washed. During rain, the rain water falls onto the top 22 of the storage unit 10. The curved top 22 urges rain water toward the left and right sides of the storage unit 10. Further, the left and right side portions 90*a, b* (see FIGS. 1) of the top 22 do not have an overhang but smoothly transition to the left and right side walls 24, 26. Accordingly, rain water that falls on the top 22 smoothly rolls onto the left and right sides walls 24, 26. The same smooth transition may be employed for the transition between the top 22 and the front and rear walls 30, 28.

As the rain water smoothly runs down the side walls 24, 26, 28, 30, the rain water reaches the bottom of the side walls 24, 26, 28, 30. The side walls 24, 26, 28, 30 are inserted into a mating groove 50 to prevent rain water from entering the interior cavity 18. The junctions at the edges 42*a, b, c, d* and the groove 50 may also be caulked with a water proof sealant 58 to further prevent rain water from entering the storage area 20, as shown in FIGS. 4, 4*a*, 4*b*. Rain water that rolls down toward the door body 74 may be urged away from the entrance 34 of the storage area 20 by the lip 36 and by the door body 74 itself to prevent water from entering the storage area 20.

The storage unit 10 may be opened such that items may be placed into or taken out of the storage unit 10. The storage unit 10 may also be closed such that unauthorized personnel may not enter the storage unit 10 to remove items placed therein for storage. When the door 14 is closed, the storage unit 10 provides a substantially dry environment for the items stored therein. To open the storage unit 10, the padlock 80 (if one is used) may be removed from the padlock eye 84. The second leaf 82*b* may be rotated off of the padlock eye 84. At this point, the door body 74 may be slid upward to open the storage unit 10. The handle 70 may be grasped and pulled upward which folds the door body 74 in a rolled configuration above the entrance 34. Additionally, the bottom edge 72 of the door body 74 is removed from the groove 76. To close the storage unit 10, the handle 70 may be grasped and pulled downward until the bottom edge 72 of the door body 74 is inserted into the groove 76. The second leaf 82*b* may be rotated over the padlock eye 84 which is received through the aperture 86 of the second leaf 82*b*. The padlock 80 may then be locked onto the padlock eye 84 to lock the door 14 in the closed position (see FIG. 1).

Figure 6A:
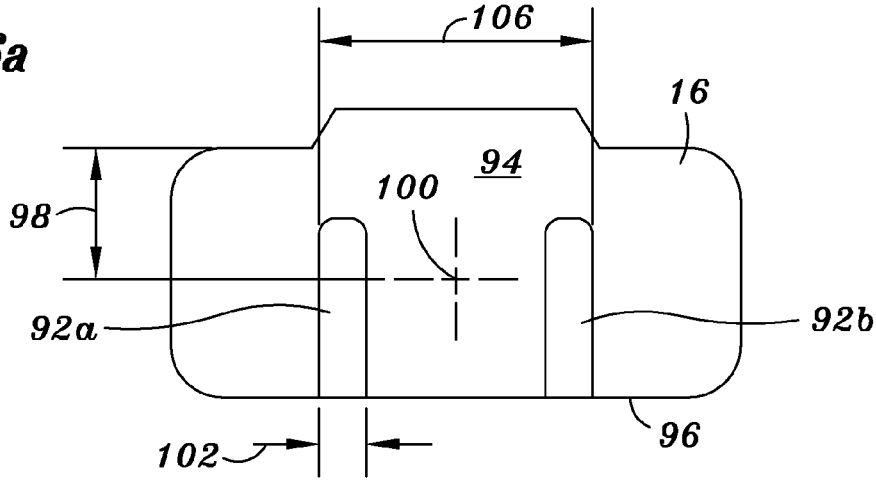
FIG. 6*a* is a bottom view of the base illustrating two fork recesses.
Figure 6B:
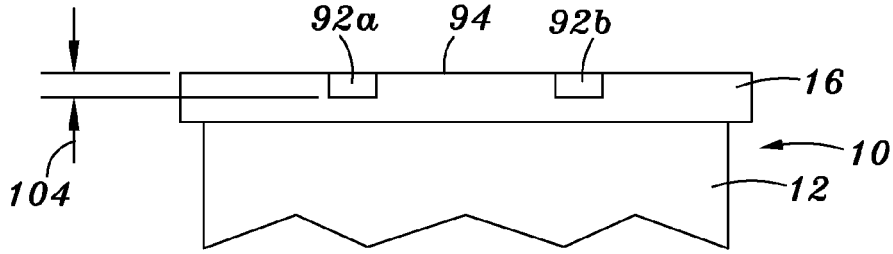
FIG. 6*b* is a rear view of the storage unit of FIG. 6*a;*

The storage unit 10 may be moved from one location to another via pallet jack recesses 92*a, b* formed in the base 16, as shown in FIGS. 6*a* and 6*b*. FIG. 6*a* is a bottom view of the base 16, and FIG. 6*b* is a rear view of the storage unit 10. Two fork recesses 92*a, b* are formed on a bottom surface 94 of the base 16. The fork recesses 92*a, b* extend from a rear surface 96 of the base 16 to a forward portion 98 of the base 16 at least beyond the center of gravity 100 of the storage unit 10. Preferably, the fork recesses 92*a, b* extend beyond the storage unit's center of gravity 100 such that front wheels of the pallet jack may traverse past the storage unit's center of gravity. The width 102 and height 104 of each fork recess 92*a, b* is sized to be sufficiently large to receive forks of the pallet jack. For example, the width 102 may be larger than 6 inches and the height 104 may be larger than 3⅛ inch. The recesses 92*a, b* are also parallel to each other and spread apart from each other to receive the forks of the pallet jack. For example, the recesses may be 21 inches, 24 inches or 27 inches apart from each other, as indicated by 106. Accordingly, the storage unit 10 may be moved from one location to another location by inserting the forks of the pallet jack into the recesses 92*a, b*, lifting the forks to an elevated position and pushing/pulling the storage unit 10 around with the pallet jack.

Figure 7A:
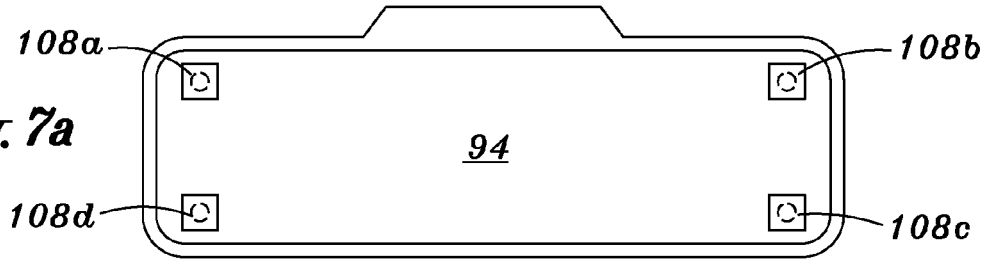
FIG. 7*a* is a bottom view of the base illustrating four casters attached to a bottom surface of the base.
Figure 7B:
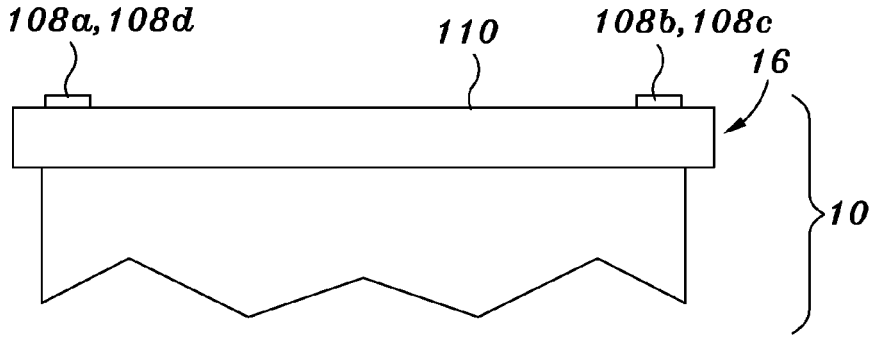
FIG. 7*b* is a rear view of the storage unit of FIG. 7*a;*
Figure 8A:
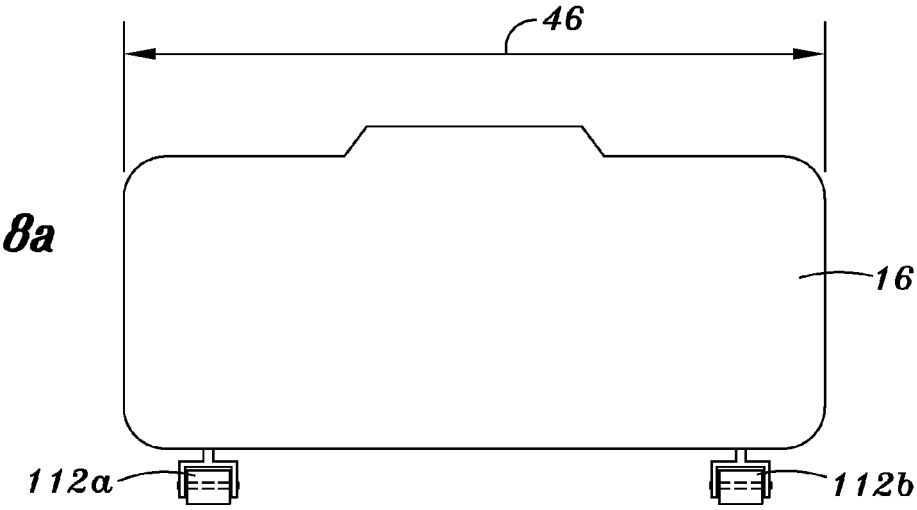
FIG. 8*a* is a bottom view of the base illustrating two rollers attached to the rear of the storage unit.
Figure 8B:
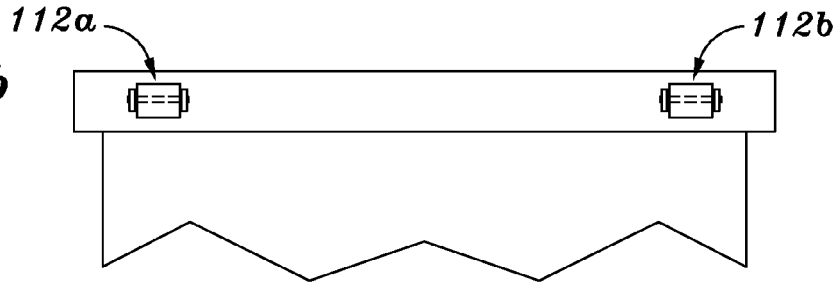
FIG. 8*b* is a rear view of the storage unit of FIG. 8*a*.

Alternatively, the storage unit 10 may be moved from one location to another location via a set of casters 108*a, b, c, d* on the bottom surface 94 of the base 16, as shown in FIGS. 7*a* and 7*b*. FIG. 7*a* is a bottom view of the base 16, and FIG. 7*b* is a rear view of the storage unit 10. The bottom surface 94 of the base 16 may be recessed, and the four casters 108*a, b, c, d* may be attached to the four corners of the base 16 to maximize the stability of the storage unit 10. The casters 108*a, b, c, d* may be sufficiently strong to withstand the weight of the storage unit 10 plus a maximum load storeable within the storage unit 10. As shown in FIG. 7*b*, the four casters 108*b, c* may extend slightly beyond the bottom edge 110 of the base 16 so as to allow the storage unit 10 to be rolled around. The front two casters 108*a, b* may swivel, whereas, the rear two casters 108*c, d* may be fixed in the forward direction. In this way, the storage unit 10 may be steered left and right to move the storage unit 10 from one location to another location.

In another alternate embodiment, two rollers 112*a, b* may be attached to the base 16. The storage unit 10 may be tilted rearward, as shown by arrow 114 in FIG. 2, to rest the weight of the storage unit 10 onto the two rollers 112*a, b*. The storage unit 10 may then be rolled in this tilted orientation from one location to another location. Once the storage unit 10 is moved to its final location, the storage unit 10 is leveled. The rollers 112*a, b* may be spread apart from each other to provide stability when the storage unit 10 is tilted for movement. For example, each roller 112*a, b* may be placed approximately ⅛ to ¼ of the entire length 46 of the base 16 from the sides of the storage unit 10. These rollers 112*a, b* may be sized to be sufficiently strong to support the weight of the storage unit 10.

The above description is given by way of example, and not limitation. Given the above disclosure, one skilled in the art could devise variations that are within the scope and spirit of the invention disclosed herein, including various locking mechanisms 78 and doors 14. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A storage unit for storing items, the unit comprising:

a) a shell having a top wall, a rear side wall, a left side wall, a right side wall and a front side wall which define respective lower edges, the front side wall having an aperture defining an outer periphery for moving items in and out of the unit, the outer periphery of the aperture defined by a first side, a second side, a top, and a bottom; the outer periphery of the aperture including a water diverting shield formed thereof, the water diverting shield being configured to run along the first side, the top, and the second side of the outer periphery to divert water away from the aperture;

b) a base having a top surface defining a top surface periphery, the base further including a first groove which defines a u-shaped configuration in a transverse cross section and is formed within the base and extending into the base from the top surface, the first groove being spaced from the top surface periphery to be contained within the base, the groove being sized and configured to receive the lower edges of the rear side wall, the left side wall, the right side wall, and the front side wall to form a substantially water proof barrier between the rear side wall, the left side wall, the right side wall, the front side wall and the base, the top surface having a second groove; and c) a door having a door body defining a bottom edge, the door traversable between a closed position wherein the door body covers the aperture and the bottom edge is inserted into the second groove to prevent water from entering into the storage unit under the door body and an opened position wherein the door body is disposed away from the aperture and the bottom edge is removed from the second groove to allow items to be moved in and out of the storage unit.

2. The unit of claim 1, wherein the first groove defines a shape that is complimentary to a portion of the rear side wall, left side wall, and right side wall.

3. The unit of claim 1, wherein the first groove is contained within the top surface in the plane defined by the top surface.

* * * * *